US010774285B2

(12) United States Patent
Capitosti

(10) Patent No.: US 10,774,285 B2
(45) Date of Patent: Sep. 15, 2020

(54) SYNERGISTIC RUST INHIBITOR COMBINATION FOR LUBRICATING GREASE

(71) Applicant: The Lubrizol Corporation, Wickliffe, OH (US)

(72) Inventor: Scott Capitosti, Perry, OH (US)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 14 days.

(21) Appl. No.: 15/537,914

(22) PCT Filed: Dec. 21, 2015

(86) PCT No.: PCT/US2015/067000
§ 371 (c)(1),
(2) Date: Jun. 20, 2017

(87) PCT Pub. No.: WO2016/109275
PCT Pub. Date: Jul. 7, 2016

(65) Prior Publication Data

US 2017/0369809 A1 Dec. 28, 2017

Related U.S. Application Data

(60) Provisional application No. 62/097,298, filed on Dec. 29, 2014.

(51) Int. Cl.
*C10M 141/10* (2006.01)
*C10M 113/00* (2006.01)

(52) U.S. Cl.
CPC ..... *C10M 141/10* (2013.01); *C10M 113/00* (2013.01); *C10M 2207/1256* (2013.01); *C10M 2215/223* (2013.01); *C10M 2215/224* (2013.01); *C10M 2223/04* (2013.01); *C10M 2223/042* (2013.01); *C10M 2223/043* (2013.01); *C10N 2210/01* (2013.01); *C10N 2220/025* (2013.01); *C10N 2230/12* (2013.01); *C10N 2250/10* (2013.01)

(58) Field of Classification Search
CPC ..... C10M 133/46; C10M 137/04; C10M 141/10; C10M 113/00; C10M 2215/223; C10M 2207/1256; C10M 2223/043; C10M 2223/042; C10M 2215/224; C10M 2223/04; C10N 2220/025; C10N 2210/01; C10N 2250/10
USPC ..... 508/421
See application file for complete search history.

(56) References Cited

U.S. PATENT DOCUMENTS

| | | | | |
|---|---|---|---|---|
| 6,566,408 | B1 | 5/2003 | Cotrell et al. | |
| 2013/0130953 | A1* | 5/2013 | Spagnoli | C10M 115/08 508/136 |

FOREIGN PATENT DOCUMENTS

| | | | |
|---|---|---|---|
| CN | 102443461 | A | 5/2012 |
| EP | 0059461 | A1 | 9/1982 |
| WO | 2007135017 | A1 | 11/2007 |

OTHER PUBLICATIONS

Thomson Scientific, Abstract of CN102443461, Database WPI, Week 201253, London, GB.
European Patent Office, International Search Report for International Patent Application No. PCT/US15/067000, dated Mar. 21, 2016.
European Patent Office, Written Opinion for International Patent Application No. PCT/US15/067000, dated Mar. 21, 2016.
European Patent Office, Second Written Opinion for International Patent Application No. PCT/US15/067000, dated Nov. 24, 2016.
European Patent Office, International Preliminary Report on Patentability for International Patent Application No. PCT/US15/067000, dated Mar. 21, 2017.

* cited by examiner

*Primary Examiner* — Prem C Singh
*Assistant Examiner* — Francis C Campanell
(74) *Attorney, Agent, or Firm* — Christopher P. Demas; Teresan W. Gilbert

(57) ABSTRACT

The disclosed technology relates to an additive composition and lubricating grease composition containing a synergistic combination of ingredients for inhibiting rust, particularly rust on mechanical devices subject to contact with salt water.

10 Claims, No Drawings

SYNERGISTIC RUST INHIBITOR COMBINATION FOR LUBRICATING GREASE

BACKGROUND OF THE INVENTION

The disclosed technology relates to an additive composition and lubricating grease composition containing a synergistic combination of ingredients for inhibiting rust, particularly rust on mechanical devices subject to contact with salt water.

There is a current and ongoing need for new salt water rust inhibitors for grease. Currently commercially available rust inhibitors can in some circumstances provide excellent distilled water corrosion inhibition. One such rust inhibitor is, for example, an amine salt of a dialkyl phosphate. However, there currently is no rust inhibitor available that can provide suitable rust inhibition under salt water conditions.

Consequently, there is a need for solutions to improve rust inhibition of grease additives and lubricating grease composition under salt water conditions.

SUMMARY OF THE INVENTION

The disclosed technology solves the problem of salt water rust inhibition by providing a synergetic rust inhibiting combination of 1) at least one salt of a phosphate hydrocarbon ester, and 2) at least one imidazoline.

Accordingly, one aspect of the present technology is an additive composition comprising 1) at least one salt of a phosphate hydrocarbon ester, and 2) at least one imidazoline.

In an embodiment, the salt of a phosphate hydrocarbon ester can be a monoalkyl phosphate. In a particular embodiment, the alkyl of the monoalkyl group can be a $C_4$ to $C_{40}$ alkyl group.

In another embodiment, the salt of a phosphate hydrocarbon ester can be a dialkyl phosphate. In a particular embodiment, the alkyl groups in the dialkyl phosphate can each include, individually, a $C_4$ to $C_{40}$ alkyl group.

In a further embodiment the salt of a phosphate hydrocarbon ester can be a mixture of monoalkyl phosphates and dialkyl phosphates.

In one embodiment, the salt of the salt of a phosphate hydrocarbon ester can be an amine salt. In a further embodiment, the salt of the salt of a phosphate hydrocarbon ester can be an alkali metal salt, for example, a sodium or potassium salt. In a still further embodiment, the salt of the salt of a phosphate hydrocarbon ester can be an alkaline earth metal salt, for example, a magnesium or calcium salt. In an embodiment, the salt of the salt of a phosphate hydrocarbon ester can be a mixture of at least two salts chosen from amine salts, alkali metal salts, and alkaline earth metal salts.

In a particular embodiment, the at least one salt of a phosphate hydrocarbon ester can be an amine salt of a phosphate hydrocarbon ester of formula:

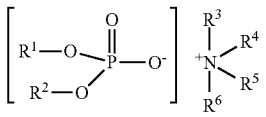

wherein:

$R^1$ and $R^2$ can be, independently, hydrogen or a hydrocarbon containing from 4 to 40 carbon atoms, with the proviso that at least one of $R^1$ or $R^2$ is a hydrocarbon group; and $R^3$, $R^4$, $R^5$ and $R^6$ can be, independently, hydrogen or a hydrocarbyl group containing from 4 to 40 carbon atoms, with the proviso that at least one of $R^3$, $R^4$, $R^5$ and $R^6$ can be a hydrocarbyl group.

In an embodiment, the imidazoline in the composition can include an N-hydrocarbyl substituted imidazoline. In the same, or different embodiment, the imidazoline can be the condensation product of a carboxylic acid with a polyamine.

In an embodiment, the N-hydrocarbyl substituted imidazoline in the additive composition or lubricating grease composition can be represented by the structure of formula:

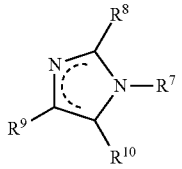

wherein the dashed line indicates resonance, $R^7$ can be a hydrocarbyl group containing from 2 to 18 carbon atoms and at least one heteroatom, $R^8$ can be hydrogen or a hydrocarbyl group containing from 1 to 40 carbon atoms, and $R^9$ and $R^{10}$ can be, independently, hydrogen or a hydrocarbyl group containing from 1 to 4 carbon atoms.

In an embodiment of the N-hydrocarbyl substituted imidazoline, the N-hydrocarbyl substituent thereof can be a $C_1$ to $C_{30}$ alcohol.

In the same or different embodiment of the N-hydrocarbyl substituted imidazoline, the at least one heteroatom of $R^7$ can be at least one of O, N, S, a halogen, or a combination thereof.

In another aspect of the present technology, there is provided a lubricating grease composition. The lubricating grease composition can include 1) a major amount of an oil of lubricating viscosity, 2) a grease thickener, 3) at least one salt of a phosphate hydrocarbon ester, and 4) at least one N-hydrocarbyl substituted imidazoline. In an embodiment, the lubricating grease composition can further contain 5) other performance additives.

In one embodiment, the lubricating grease composition can include the at least one salt of the phosphate hydrocarbon ester from about 0.5 to about 10 weight percent based on the total weight of the lubricating grease.

In the same or different embodiment, the lubricating grease composition can include the at least one N-hydrocarbyl substituted imidazoline from about 0.5 to about 10 weight percent based on the total weight of the lubricating grease.

In some embodiments, the grease thickener in the lubricating grease composition can be lithium based.

Another aspect of the present technology includes a method of operating a mechanical device. The method can include A) supplying to the mechanical device a lubricating grease composition as described herein, i.e., having 1) a major amount of an oil of lubricating viscosity, 2) at least one salt of a phosphate hydrocarbon ester, and 3) at least one N-hydrocarbyl substituted imidazoline, and B) operating the mechanical device.

DETAILED DESCRIPTION OF THE INVENTION

Various preferred features and embodiments will be described below by way of non-limiting illustration.

The present technology includes an additive composition containing 1) at least one salt of a phosphate hydrocarbon ester, and 2) at least one imidazoline, such as, for example, an N-hydrocarbyl substituted imidazoline. In an embodiment, the additive composition comprises 1) and 2). In another embodiment, the additive composition consists essentially of 1) and 2). In a further embodiment, the additive composition consists of 1) and 2). The ratio of the at least one salt of a phosphate hydrocarbon ester to the imidazoline in the additive composition may be from about 1:10 to about 10:1, or from about 1:5 to 5:1, or in some instances from about 1:3 to about 3:1. In an embodiment, the ratio of the at least one salt of a phosphate hydrocarbon ester to the imidazoline, such as, for example, an N-hydrocarbyl substituted imidazoline, in the additive composition may be from about 1:3 to about 3:1, or from about 1:2 to about 2:1, or even from about 1:1.5 to about 1.5:1, or about 1:1.

Salt of a Phosphate Hydrocarbon Ester

The additive and/or grease composition contains at least one phosphorus compound that may be a salt of a phosphate hydrocarbon ester (i.e., a salt of a hydrocarbon ester of phosphoric acid). The salt of a phosphate hydrocarbon ester may be derived from a salt of a phosphate. The phosphate hydrocarbon ester may be an amine salt, an alkali metal salt, particularly a sodium or potassium salt, or an alkaline earth metal salt, particularly a magnesium or calcium salt, or a combination of the foregoing salts. The salt of the phosphate hydrocarbon ester may be represented, for example, by the formula I:

Formula I

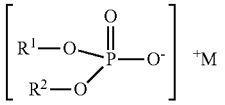

wherein $R^1$ and $R^2$ may be independently hydrogen or hydrocarbon typically containing 4 to 40, or 6 to 30, or 8 to 18, or 12 to 24, or 16 to 22 carbon atoms, with the proviso that at least one of $R^1$ or $R^2$ is a hydrocarbon group; and $M^+$ may be an amine, an alkali metal, such as, for example, Na or K, or an alkaline earth metal salt, such as, for example, Mg or Ca.

The hydrocarbon groups of $R^1$ and/or $R^2$ may be linear, branched, or cyclic.

Examples of a hydrocarbon group for $R^1$ and/or $R^2$ include straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbon group for $R^1$ and/or $R^2$ include cyclopentyl, cyclohexyl, cycloheptyl, methylcyclopentyl, dimethylcyclopentyl, methyl cyclopentyl, dimethyl cyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl.

In some embodiments, the salt of the phosphate hydrocarbon ester may be a monoalkyl phosphate salt in which one of $R^1$ or $R^2$ in Formula I is hydrogen and the other of $R^1$ or $R^2$ is the hydrocarbon. In a particular embodiment, the salt of the phosphate hydrocarbon ester may be a monoalkyl phosphate salt, wherein the monoalkyl group (i.e., one of $R^1$ or $R^2$) contains 4 to 40 carbon atoms. In other embodiments, the salt of the phosphate hydrocarbon ester may be a dialkyl phosphate salt in which both of $R^1$ and $R^2$ in Formula I are hydrocarbons. In a particular embodiment, the salt of the phosphate hydrocarbon ester may be a dialkyl phosphate salt, wherein the alkyl groups (i.e., both of $R^1$ and $R^2$) contain, individually, 4 to 40 carbon atoms. The salt of the phosphate hydrocarbon ester can also be a mixture of both monoalkyl phosphate salts and dialkyl phosphate salts.

In an embodiment, the salt of the phosphate hydrocarbon ester may be an alkali metal salt, and in another embodiment the salt of the phosphate hydrocarbon ester may be a sodium salt or a potassium salt. In an embodiment, the salt of the phosphate hydrocarbon ester may be an alkaline earth metal salt, and in another embodiment the salt of the phosphate hydrocarbon ester may be a magnesium salt or a calcium salt.

In a particular embodiment, the salt of the phosphate hydrocarbon ester may be an amine salt of a phosphate hydrocarbon ester represented, for example, by the formula II:

Formula II

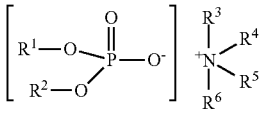

wherein $R^1$ and $R^2$ are as defined above; and $R^3$, $R^4$, $R^5$ and $R^6$ may be independently hydrogen or a hydrocarbyl group containing 4 to 40, or 6 to 30, or 8 to 18, or 12 to 24, or 16 to 22 carbon atoms, with the proviso that at least one of $R^3$, $R^4$, $R^5$ or $R^6$ is a hydrocarbyl group.

In one embodiment the phosphate may be an amine salt of a mixture of monoalkyl and dialkyl phosphoric acid esters. The monoalkyl and dialkyl groups may be linear or branched.

The amine salt of a phosphate hydrocarbon ester may be derived from an amine such as a primary amine, a secondary amine, a tertiary amine, or mixtures thereof. The amine may be aliphatic, or cyclic, aromatic or non-aromatic, typically aliphatic. In one embodiment the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecylamine, as well as such fatty amines as n-octylamine, n-decylamine, n-dodecylamine, n-tetradecylamine, n-hexadecylamine, n-octadecyl amine and oleyamine. Other useful fatty amines include, for example, coco-amine, oleyl-amine and low cloud point oleyl amine, tallow-amine and hydrogenated tallow-amine, soya alkylamine and distilled soya alkylamines, which may be obtained commercially, for example, from Akzo Chemicals, Chicago, Ill. in the "Armeen®" line of amines, such as Armeen C, Armeen O, Armeen OL, Armeen T, Armeen HT, Armeen S and Armeen SD.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment the amines are in the form of a mixture. Examples of suitable mixtures of amines include (i) a tertiary alkyl primary amine with 11 to 14 carbon atoms, (ii) a tertiary alkyl primary amine with 14 to 18 carbon, or (iii) a tertiary alkyl primary amine with 18 to 22 carbon atoms. Other examples of tertiary alkyl primary amines include tert-butyl amine, tert-hexyl amine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphate hydrocarbon ester may be prepared as is described in U.S. Pat. No. 6,468,946. Column 10, lines 15 to 63 describe phosphoric acid esters formed by reaction of phosphorus compounds, followed by reaction with an amine to form an amine salt of a phosphate hydrocarbon ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphate hydrocarbon ester.

Imidazoline

Imidazolines are well known materials having the general structure:

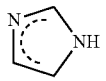

wherein the dashed line indicates resonance. Imidazolines suitable for the present technology may include imidazoline derivatives, for example, including alkyl-substituents, or fatty imidazolines.

In an embodiment, the imidazoline can be an N-hydrocarbyl substituted imidazoline. In the case of an N-hydrocarbyl substituted imidazoline, the hydrocarbyl substituent can contain 2 to 18, or 3 to 16, or 4 to 12 or 14 carbon atoms and at least one heteroatom. The heteroatom can be, for example, an oxygen atom, a nitrogen atom, a sulfur atom, a halogen, and the like, or combinations thereof.

In a particular embodiment, the N-hydrocarbyl substituted imidazoline may be represented, for example, by the formula III:

Formula III

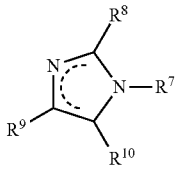

wherein the dashed line indicates resonance, $R^7$ is a hydrocarbyl group containing from 1 to 30, or 2 to 26, or 3 to 18, or 4 to 12 carbon atoms and at least one heteroatom, $R^8$ is hydrogen or a hydrocarbyl group containing from 1 to 40, or 2 to 32, or 4 to 26 carbon atoms, and $R^9$ and $R^{10}$ are independently hydrogen or a hydrocarbyl group containing from 1, 2, 3 or 4 carbon atoms.

In an embodiment, $R^9$ and $R^{10}$ may be joined together form a cyclic structure. Alternatively, $R^8$, $R^9$, and $R^{10}$ may be attached to other carbon atoms on the imidazoline ring than those shown, thus representing different isomers.

While a structure of an N-hydrocarbyl substituted imidazolines is presented, the production of N-hydrocarbyl substituted imidazolines generally results in a mixture of compounds including the N-hydrocarbyl substituted imidazoline, and this mixture may be difficult to define apart from the process steps employed to produce the N-hydrocarbyl substituted imidazoline. Further, the process by which a N-hydrocarbyl substituted imidazoline is produced can be influential in imparting distinctive structural characteristics to the N-hydrocarbyl substituted imidazoline product that can affect the properties of the N-hydrocarbyl substituted imidazoline.

As used herein, reference to N-hydrocarbyl substituted imidazoline includes reference to the mixture of compounds including the N-hydrocarbyl substituted imidazoline, as well as referring to the N-hydrocarbyl substituted imidazoline itself.

Imidazolines in general may be prepared by known methods, such as by the condensation of a carboxylic acid with a diamine or polyamine. The N-hydrocarbyl substituted imidazolines disclosed herein may likewise be prepared by condensing the appropriately substituted carboxylic acid with the appropriately substituted diamine or polyamine. For example, the N-hydrocarbyl substituted imidazolines may be prepared by condensing a carboxylic acid such as $R^8(O)OH$, or reactive equivalents thereof, with a polyamine, such as $R^7—NH(CH_2—R^9)(CH_2—R^{10})NH_2$.

In an embodiment, the N-hydrocarbyl substituted imidazoline can contain an oxygen atom. In an embodiment the N-hydrocarbyl substituent (i.e., $R^7$) in the at least one N-hydrocarbyl substituted imidazoline can be, for example, an ether or polyether, or an ester or polyester. In an embodiment, the N-hydrocarbyl substituted imidazoline can be an N-hydroxyalkyl substituted imidazoline. In an embodiment, the N-hydrocarbyl substituent in the at least one N-hydrocarbyl substituted imidazoline can be a primary, secondary or tertiary alcohol.

In an embodiment, the N-hydrocarbyl substituted imidazoline can contain a nitrogen atom. In another embodiment, the N-hydrocarbyl substituted imidazoline can be an N-alkylamine substituted imidazoline. In an embodiment, the N-hydrocarbyl substituent in the at least one N-hydrocarbyl substituted imidazoline can be a primary, secondary or tertiary amine or polyamine. In a further embodiment, the N-hydrocarbyl substituent in the at least one N-hydrocarbyl substituted imidazoline can be an ether-amine-containing group.

In a still further embodiment, the N-hydrocarbyl substituted imidazoline can be an N-thioalkyl substituted imidazoline. In an embodiment, the N-hydrocarbyl substituent in the at least one N-hydrocarbyl substituted imidazoline can be a primary, secondary or tertiary thiol.

In an embodiment, the N-hydrocarbyl substituted imidazoline can be an N-haloalkyl substituted imidazoline, wherein the halogen is selected from the group consisting of fluorine, chlorine, bromine, iodine and astatine. In an embodiment, the N-hydrocarbyl substituent in the at least one N-hydrocarbyl substituted imidazoline can be a halogenated hydrocarbyl.

In one embodiment, the N-hydrocarbyl substituted imidazoline compound may comprise a 1-(hydroxyalkyl)-2-(hydrocarbyl)imidazoline, which may be, more specifically, a 1-(2-hydroxyethyl)-2-($C_8$ to $C_{24}$ aliphatic hydrocarbyl) imidazoline, which may be represented by the general formula:

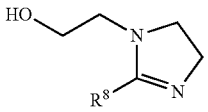

wherein $R^8$ is a branched or unbranched, saturated or unsaturated aliphatic hydrocarbon group of 8 to 24 carbon atoms.

Alternatively, in certain embodiments the $R^8$ group shown on the imidazoline ring above may be a hydrocarbyl group which may have one or more oxygen atoms. For instance, the hydrocarbyl group may contain an ether linkage, or a hydroxyl substituent, or a carbonyl group, e.g., as a ketone or as part of an ester linkage (either —OC(O)— or —C(O)O—). An example would be an imidazoline compound prepared by condensation of a hydroxystearic acid, e.g., 12-hydroxystearic acid.

In one embodiment, the imidazoline may be represented by the following formula, with suggested nomenclatures shown:

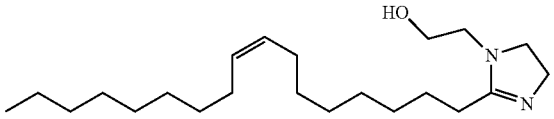

1-(Hydroxyethyl)-2-(heptadecenyl)imidazoline 1-(Hydroxyethyl)-2-(8-heptadecenyl)imidazoline 1H-Imidazole-1-ethanol, 2-(8-heptadecen-1-yl)-4,5-dihydro-although it is to be understood that the commercially available materials may be mixtures of various isomers and, in particular, the long hydrocarbyl chain may include significant variations from that shown. In particular, the double bond within the hydrocarbyl chain may be located in a different position or may be absent entirely; it may be cis or trans; or there may be more than one double bond at various locations. The carbon chain may likewise be branched. The detailed nature of the hydrocarbyl chain may reflect the structure of the fatty acid from which the imidazoline may be prepared. For instance, if the imidazoline is prepared from oleic acid, the double bond will typically be at or near the 8-position in the hydrocarbyl chain, as shown. Other acids, such as stearic acid, are fully saturated. Moreover, other components than the shown imidazoline structure shown may be present. Such materials may include the amide (non-cyclized), oxazoline, or ester condensation products.

Lubricating Grease Composition

Also included in the present technology is a lubricating grease composition. The lubricating grease composition will include the additive composition containing the 1) at least one salt of a phosphate hydrocarbon ester, and 2) at least one N-hydrocarbyl substituted imidazoline, as well as, among other things, 3) a major amount of at least one oil of lubricating viscosity, and 4) at least one grease thickener. By "major," it is meant more than 50 percent by weight of the composition, and in some embodiments, more than 60 percent by weight, or even 70 or 80 percent by weight. In an embodiment, the lubricating grease composition comprises 1), 2), 3) and 4). In another embodiment, the lubricating grease composition consists essentially of 1), 2), 3) and 4). In a further embodiment, the lubricating grease composition consists of 1), 2), 3) and 4).

The salt of the phosphate hydrocarbon ester may be present in the lubricating grease from about 0.5 to about 10 wt. % based on the total weight of the lubricating grease composition, or from about 0.75 to about 8 wt. %, or from about 1.0 to about 6 wt. %, or about 1.25 or 1.5 to about 5 wt. %.

The amount of the N-hydrocarbyl substituted imidazoline can be from about 0.5 to about 10 wt. % based on the total weight of the lubricating grease composition, or from about 0.75 to about 8 wt. %, or from about 1.0 to about 6 wt. %, or about 1.25 or 1.5 to about 5 wt. %.

Oils of Lubricating Viscosity

The lubricating grease composition comprises an oil of lubricating viscosity. Such oils include natural oils and synthetic fluids, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic fluids may also be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the April 2008 version of "Appendix E—API Base Oil Interchangeability Guidelines for Passenger Car Motor Oils and Diesel Engine Oils", section 1.3 Subheading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof. The oil could also be "re-refined" oil.

The amount of the oil of lubricating viscosity present is typically the balance remaining after subtracting from 100 wt % the sum of the amount of the grease thickener and any other performance additives. A typical grease might contain as much as 80 or 90 wt % of an API base oil.

Grease Thickener

The grease thickener may include simple metal soap grease thickeners, soap complexes, non-soap grease thickeners, metal salts of such acid-functionalized oils, polyurea and diurea grease thickeners, calcium sulfonate grease thickeners, polyurea complexes, calcium sulfonate complexes, or mixtures or co-reactions thereof.

The greases thickener may also include or be used with other known polymer thickening agents such polytetrafluoroethylene (commonly known as PTFE), styrene-butadiene rubber, styrene-isoprene, olefin polymers such as polyethylene or polypropylene or olefin co-polymers such as ethylene-propylene or mixtures thereof.

In one embodiment the thickener may also include or be used with other known thickening agents such as inorganic powders including clay, organo-clays, montmorillonite, bentonite, hectorite, fumed silica, calcium carbonate as calcite, carbon black, pigments, copper phthalocyanine or mixtures thereof.

The grease may also be a sulfonate grease. Sulfonate greases are disclosed in more detail in U.S. Pat. No. 5,308,514 and U.S. patent application Ser. No. 10/806,591. The calcium sulfonate grease may be prepared from overbasing the calcium sulfonate such that the calcium is carbonated and further reacted to form either calcite, or vaterite, typically calcite.

The grease thickener may be a urea derivative such as a polyurea or a diurea. Polyurea grease may include tri-urea, tetra-urea or higher homologues, or mixtures thereof. The urea derivatives may include urea-urethane compounds and the urethane compounds, diurea compounds, triurea compounds, tetraurea compounds, polyurea compounds, urea-urethane compounds, diurethane compounds and mixtures thereof. The urea derivative may for instance be a diurea compound such as, urea-urethane compounds, diurethane compounds or mixtures thereof. The urea derivative may for instance have a structure represented by:

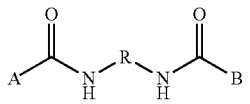

wherein R stands for a divalent hydrocarbon group, and A and B may be the same or different and each stand for $R_aNH$—, $R_bR_cN$—, or $R_d$—O—, wherein $R_a$, $R_b$, $R_c$ and $R_d$ may be the same or different and each stand for a hydrocarbon residue having 6 to 20 carbon atoms. A more detailed description of urea compounds of this type is disclosed in U.S. Pat. No. 5,512,188 column 2, line 32 to column 23, line 23.

A diurea compound or the urea-urethane or diurethane (such as diisocyanate represented by OCN—R—NCO may be reacted with one or more of $R_aNH_2$—, $R_bR_cNH$, or $R_d$—OH, wherein variables R, a, b, c and d are the same as described above.

In one embodiment a diurea compound typically employed in a CVJ grease may be represented by the formula:

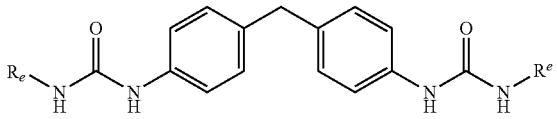

wherein each $R_e$ may independently be a straight hydrocarbon chain of between 8 and 22 carbon atoms with either zero or one unsaturated double bond, or each $R_e$ may independently may be alicylic with a 5- 6- or 7 membered saturated ring with a hydrocarbyl tail of up to 20 carbon atoms or an aromatic 6-membered hydrocarbon ring with a hydrocarbyl tail of up to 20 carbon atoms.

In one embodiment the grease thickener may be polyurea or diurea. In another embodiment, the grease thickener can be a lithium soap or lithium complex thickener. In a still further embodiment, the grease thickener can be a calcium sulfonate thickener.

The amount of grease thickener in the lubricating grease composition includes those in the range from 0.1 wt % to 45 wt %, or 1 wt % to 40 wt %, or 1 wt % to 20 or 25 wt % of the grease composition.

Other Performance Additives

A grease composition may be prepared by adding the additive composition described above to an oil of lubricating viscosity, a grease thickener, and optionally in the presence of other performance additives (as described herein below). The other performance additives may be present at 0 wt % to 10 wt %, or 0 wt % to 5 wt %, or 0.1 to 3 wt % of the grease composition.

The grease composition optionally comprises other performance additives. The other performance additives include at least one of metal deactivators, viscosity modifiers, detergents, friction modifiers (other than the compounds disclosed herein), anti-wear agents (other than the compounds disclosed herein), corrosion inhibitors, non-dispersant viscosity modifiers, extreme pressure agents, antioxidants, and mixtures thereof.

In one embodiment the grease composition optionally further includes at least one other performance additive. The other performance additive compounds include a metal deactivator, a detergent, an anti-wear agent, an antioxidant, a corrosion inhibitor (typically a rust inhibitor), agent, extreme pressure agent, or mixtures thereof. Typically, a fully-formulated grease composition will contain one or more of these performance additives. The grease composition may contain corrosion inhibitor or an antioxidant.

Antioxidants include diarylamine, alkylated diarylamines, hindered phenols, molybdenum compounds (such as molybdenum dithiocarbamates), hydroxyl thioethers, trimethyl polyquinoline (e.g., 1,2-dihydro-2,2,4-trimethylquinoline), or mixtures thereof. In one embodiment the grease composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the grease composition.

The diarylamine and alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines. The alkylated diarylamine may be a tetra-alkylated diarylamine.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from BASF. A more detailed description of suitable ester-containing hindered phenol antioxidant chemistry is found in U.S. Pat. No. 6,559,105.

In one embodiment the grease composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The non-dispersant viscosity modifier may include functionalized polyolefins, for example, ethylene-propylene copolymers that have been functionalized with an acylating agent such as maleic anhydride and an amine; polymethacrylates functionalized with an amine, or styrene-maleic anhydride copolymers reacted with an amine. More detailed description of non-dispersant viscosity modifiers are disclosed in U.S. Pat. No. 6,300,288 to Scharf et al., issued Oct. 9, 2001.

In one embodiment there is provided a grease composition further comprising an overbased metal-containing detergent. The overbased metal-containing detergent may be a calcium, sodium, or magnesium overbased detergent.

The overbased metal-containing detergent may be selected from the group consisting of non-sulfur containing phenates, sulfur containing phenates, sulfonates, salixarates, salicylates, and mixtures thereof, or borated equivalents thereof. The overbased metal-containing detergent may be may be selected from the group consisting of non-sulfur containing phenates, sulfur containing phenates, sulfonates, and mixtures thereof. The overbased detergent may be borated with a borating agent such as boric acid such as a borated overbased calcium, sodium, or magnesium sulfonate detergent, or mixtures thereof.

In one embodiment the grease disclosed herein may contain a friction modifier. The friction modifier may be present at 0 wt % to 6 wt %, or 0.01 wt % to 4 wt %, or 0.05 wt % to 2 wt %, or 0.1 wt % to 2 wt % of the grease composition.

Friction modifiers may also encompass materials such as sulfurized fatty compounds and olefins, molybdenum dialkyldithiophosphates, molybdenum dithiocarbamates, or other oil soluble molybdenum complexes such as Molyvan® 855 (commercially available from R.T. Vanderbilt, Inc) or Sakuralube® S-700 or Sakuralube® S-710 (commercially available from Adeka, Inc). The oil soluble molybdenum complexes assist in lowering the friction, but can compromise seal compatibility.

In one embodiment the friction modifier may be an oil soluble molybdenum complex. The oil soluble molybdenum complex may include molybdenum dithiocarbamate, molybdenum dithiophosphate, molybdenum blue oxide complex or other oil soluble molybdenum complex or mixtures thereof. The oil soluble molybdenum complex may be a mix of molybdenum oxide and hydroxide, so called "blue" oxide. The molybdenum blue oxides have the molybdenum in a mean oxidation state of between 5 and 6 and are mixtures of MoO2(OH) to MoO2.5(OH)0.5. An example of the oil soluble is molybdenum blue oxide complex known by the trade name of Luvodur® MB or Luvodur® MBO (commercially available from Lehmann and Voss GmbH), The oil soluble molybdenum complexes may be present at 0 wt % to 5 wt %, or 0.1 wt % to 5 wt % or 1 to 3 wt % of the grease composition.

In one embodiment the friction modifier may be a long chain fatty acid ester. In another embodiment the long chain fatty acid ester may be a mono-ester and in another embodiment the long chain fatty acid ester may be a triglyceride such as sunflower oil or soybean oil or the monoester of a polyol and an aliphatic carboxylic acid.

The grease composition optionally further includes at least one anti-wear agent. Examples of suitable anti-wear agents include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl or dioleyl phosphite), phosphonates, thiocarbamate-containing compounds, such as thiocarbamate esters, thiocarbamate amides, thiocarbamic ethers, alkylene-coupled thiocarbamates, bis(S-alkyldithiocarbamyl) disulfides, and oil soluble phosphorus amine salts. In one embodiment the grease composition may further include metal dihydrocarbyldithiophosphates (such as zinc dialkyldithiophosphates).

The Extreme pressure agent may be a compound containing sulfur and/or phosphorus. Examples of an extreme pressure agents include a polysulfide, a sulfurized olefin, a thiadiazole, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulfur-sulfur bond between 2,5-dimercapto-1,3,4-thiadiazole units to form oligomers of two or more of said thiadiazole units. Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilized. In different embodiments the number of carbon atoms on the hydrocarbyl-substituent group includes 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

In one embodiment at least 50 wt % of the polysulfide molecules are a mixture of tri- or tetra-sulfides. In other embodiments at least 55 wt %, or at least 60 wt % of the polysulfide molecules are a mixture of tri- or tetra-sulfides.

The polysulfide includes a sulfurized organic polysulfide from oils, fatty acids or ester, olefins or polyolefins.

Oils which may be sulfurized include natural or synthetic fluids such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rape-seed oil, and fish oil.

The polysulfide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulfurized olefin includes an olefin derived from propylene, isobutylene, pentene or mixtures thereof.

In one embodiment the polysulfide comprises a polyolefin derived from polymerizing by known techniques an olefin as described above.

In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, and sulfurized Diels-Alder adducts.

The extreme pressure agent may be present at 0 wt % to 5 wt %, 0.01 wt % to 4 wt %, 0.01 wt % to 3.5 wt %, 0.05 wt % to 3 wt %, and 0.1 wt % to 1.5 wt %, or 0.2 wt % to 1 wt % of the lubricating composition.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Corrosion inhibitors useful for a mechanical device include 1-amino-2-propanol, amines, triazole derivatives including tolyltriazole, dimercaptothiadiazole derivatives, octylamine octanoate, condensation products of dodecenyl succinic acid or anhydride and/or a fatty acid such as oleic acid with a polyamine.

The grease composition may comprise:

(a) from about 0.5 wt % to about 10 wt % of at least one salt of a phosphate hydrocarbon ester;

(b) from about 0.5 wt % to about 10 wt. % of at least one N-hydrocarbyl substituted imidazolines;

(c) 0.1 wt % to 45 wt % of a grease thickener;

(d) 0 wt % to 10 wt % of other performance additives; and (e) balance of an oil of lubricating viscosity.

INDUSTRIAL APPLICATION

The combination of a the salt of a phosphate hydrocarbon ester and the N-hydrocarbyl substituted imidazoline in the above described additive compositions may be employed to provide a synergistic improvement in rust inhibition for mechanical devices subjected to salt water environments.

In an embodiment, the present technology provides a method of operating a mechanical device comprising A) supplying to the mechanical device a lubricating grease composition comprising 1) a major amount of an oil of lubricating viscosity, 2) at least one salt of a phosphate hydrocarbon ester, and 3) at least one N-hydrocarbyl substituted imidazoline, and B) operating the mechanical device.

The additive composition and lubricating grease compositions may therefore be employed on mechanical devices, for example, near the sea or the ocean. The mechanical devices may include, for example, a bearing, or a joint. The mechanical device bearing, or joint may be within an automotive power transmission, a driveline device, a vehicle suspension or steering system, or a hydraulic system. In one embodiment the mechanical device may be an automobile driving shaft. The mechanical device may contain a constant velocity joint.

The grease may include a lithium soap grease made with a monocarboxylic acid (a simple soap grease), a lithium complex soap grease, a calcium soap grease or a calcium complex soap grease, or urea or urea complex grease.

The grease composition may also be useful for a low noise grease which are known and typically used in rolling element bearing applications such as pumps or compressors.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein is useful for preventing rust on a mechanical device, particularly where the mechanical device is subject to contact with salt water, which may be better understood with reference to the following examples.

EXAMPLES

A comprehensive study was undertaken to identify new grease salt water rust inhibitors. The study reviewed individual components as well as combinations of components. All the data generated in the study was from a group I simple lithium grease with 3 wt % of a standard grease additive package and an appropriate amount of a sample rust inhibitor under review. The formulation of the grease can be seen in Table 1.

TABLE 1

| Ingredient | Wt. % |
|---|---|
| Oil of lubricating viscosity | 29-36% |
| Lithium soap base grease thickener | 60% |

TABLE 1-continued

| Ingredient | Wt. % |
|---|---|
| Extreme Pressure and Anti-wear Containing Additive Package | 3% |
| Sample Rust Preventative | 1-8% |

Sample 1—A $C_8$-amine salt of a phosphate dioctyl ester.

Sample 2—A reaction product of naphthenic acid and diethylenetriamine providing a mixture containing an N-hydrocarbyl substituted imidazoline.

Sample 3—Anedco® AC-163—reaction product of tall oil fatty acid and diethylenetriamine, providing a mixture containing N—$C_{18}$ substituted imidazoline.

Sample 4—Anedco® AC-164—reaction product of tall oil fatty acid and aminoethyl ethanolamine, providing a mixture containing N—$C_{18}$ substituted imidazoline.

Sample 5—Reaction product of isostearic acid and tetraethylenepentamine, providing a mixture containing an N-hydrocarbyl substituted imidazoline.

Sample 6—Reaction product of tall oil fatty acid and aminoethyl ethanolamine, providing a mixture containing N—$C_{11-19}$ (mostly $C_{18}$) substituted imidazoline.

Sample 7—Reaction product of tall oil fatty acid and aminoethyl ethanolamine, providing a mixture containing N—$C_{11-19}$ (mostly $C_{18}$) substituted imidazoline.

Sample 8—Reaction product of tall oil fatty acid and aminoethyl ethanolamine, providing a mixture containing an N—$C_{18}$ substituted imidazoline.

Grease formulations containing various combinations of Samples 1 through 12 were tested in ASTM D5969 (10% synthetic sea water ("SSW"), see ASTM D665-2012, paragraph 6.3 for a definition of SSW). This test method covers the determination of the corrosion preventive properties of greases using lubricated tapered roller bearings exposed to various concentrations of dilute synthetic sea water stored under wet conditions. In the test, a new bearing is cleaned and packed with a lubricating grease. The bearings are run under a light load to evenly distribute the grease in a pattern consistent with that found in service. The bearings are then exposed to SSW and stored for 24 h at 52° C. and 100% relative humidity. After cleaning, the bearing cups are examined for evidence of corrosion. The following rating scale of the rust present was used for the results (Clean=0, Trace=1, Light=2, Med=3, Heavy=4). Each test had results on three bearings. These three results were added together to get the rating per test, which could range from 0 to 12. (0 meaning all three bearings clean, 12 meaning all three bearings had heavy rust). For a give sample, the "Overall Rating" is the sum of the bearing ratings over the total number of tests performed. The results of the testing are shown in Table 2 below.

TABLE 2

| Sample # | Treat Rate (%) | # Tests | Overall Rating |
|---|---|---|---|
| 1 | 2% | 2 | 5.0 |
| 1 | 3% | 2 | 3.0 |
| 1 | 4% | 2 | 2.5 |
| 1 | 5% | 2 | 2.5 |
| 1 | 6% | 2 | 3.0 |
| 1 | 7% | 2 | 3.0 |
| 1 | 8% | 2 | 3.0 |
| 2 | 2% | 4 | 7.0 |
| 3 | 2% | 2 | 6.0 |
| 3 | 3% | 2 | 6.0 |
| 3 | 4% | 2 | 6.0 |
| 3 | 5% | 2 | 4.0 |
| 3 | 6% | 2 | 5.0 |
| 4 | 2% | 2 | 6.0 |
| 4 | 3% | 2 | 6.0 |
| 4 | 4% | 2 | 7.5 |
| 4 | 5% | 2 | 4.0 |
| 4 | 6% | 2 | 5.5 |
| 5 | 2% | 2 | 9.0 |
| 5 | 3% | 2 | |
| 5 | 4% | 2 | |
| 5 | 5% | 2 | |
| 6 | 2% | 2 | 7.5 |
| 6 | 3% | 2 | 6.5 |
| 6 | 4% | 2 | 6.5 |
| 6 | 5% | 2 | 6.0 |
| 6 | 6% | 2 | 7.0 |
| 7 | 2% | 2 | 3.0 |
| 7 | 3% | 2 | 3.0 |
| 7 | 4% | 2 | 3.0 |
| 7 | 5% | 2 | |
| 7 | 6% | 2 | |
| 8 | 2% | 2 | 6.0 |
| 8 | 3% | 2 | 3.0 |
| 8 | 4% | 2 | 4.0 |
| 8 | 5% | 2 | 3.0 |
| 8 | 6% | 2 | 2.5 |

Combinations of the phosphate salt of sample 1 and the various imidazolines samples 3 through 8 were also tested. Results for the combined formulations are provided in Table 3 below.

TABLE 3

| | Sample # | Treat Rate (%) | Sample # | Treat Rate (%) | # Tests | Test Rating |
|---|---|---|---|---|---|---|
| S010-2602-12-151 | 7 | 1.00% | 1 | 1.00% | 2 | 3.0 |
| S010-2602-12-152 (157) | 7 | 2.00% | 1 | 2.00% | 4 | 2.25 |
| S010-2602-12-259 | 7 | 2.50% | 1 | 2.50% | 2 | |
| S010-2602-12-260 | 7 | 3.00% | 1 | 3.00% | 2 | |
| S010-2602-12-159 | 5 | 2.00% | 1 | 2.00% | 2 | 2.5 |
| S010-2602-12-264 | 5 | 2.50% | 1 | 2.50% | 2 | |
| S010-2602-12-265 | 5 | 3.00% | 1 | 3.00% | 2 | |
| S010-2602-12-228 | 6 | 2.50% | 1 | 2.50% | 2 | 0.5 |
| S010-2602-12-230 | 6 | 1.25% | 1 | 3.75% | 2 | 0.0 |
| S010-2602-12-232 | 6 | 3.00% | 1 | 3.00% | 2 | 1.0 |
| S010-2602-12-213 | 4 | 1.00% | 1 | 3.00% | 2 | 0.5 |
| S010-2602-12-215 | 4 | 2.50% | 1 | 2.50% | 2 | 1.0 |
| S010-2602-12-217 | 4 | 1.25% | 1 | 3.75% | 2 | 0.5 |

TABLE 3-continued

| | Sample # | Treat Rate (%) | Sample # | Treat Rate (%) | # Tests | Test Rating |
|---|---|---|---|---|---|---|
| S010-2602-12-219 | 4 | 3.00% | 1 | 3.00% | 2 | 0.5 |
| S010-2602-12-195 | 3 | 1.50% | 1 | 1.50% | 2 | 0.5 |
| S010-2602-12-200 | 3 | 1.00% | 1 | 3.00% | 2 | 0.5 |
| S010-2602-12-202 | 3 | 2.50% | 1 | 2.50% | 2 | 1.0 |
| S010-2602-12-204 | 3 | 1.25% | 1 | 3.75% | 2 | 0.0 |
| S010-2602-12-206 | 3 | 3.00% | 1 | 3.00% | 2 | 0.0 |
| S010-2602-12-183 | 8 | 1.80% | 1 | 1.20% | 2 | 0.5 |
| S010-2602-12-189 | 8 | 2.50% | 1 | 2.50% | 2 | 1.0 |
| S010-2602-12-154 | 8 | 2.00% | 1 | 3.00% | 4 | 0.5 |
| S010-2602-12-190 | 8 | 3.75% | 1 | 1.25% | 2 | 1.0 |
| S010-2602-12-193 | 8 | 3.00% | 1 | 3.00% | 2 | 0.5 |

As can be seen in Table 3, mixtures of a salt of a phosphate hydrocarbon ester with an imidazoline at total treat rates as low as 3 wt % have given passing results in ASTM D5969 (10% SSW). In this type of grease formulation, a salt of a phosphate hydrocarbon ester alone could not achieve a passing result in ASTM D5969 (10% SSW) at concentrations up to 8 w %.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricating grease composition comprising 1) a major amount of an oil of lubricating viscosity, 2) a grease thickener, 3) about 0.5 to about 10 wt. % of at least one salt of the phosphate hydrocarbon ester, wherein the salt of a phosphate hydrocarbon ester comprises a monoalkyl phosphate, dialkyl phosphate, or mixture thereof, and 4) about 0.5 to about 5 wt. % of at least one N-hydrocarbyl substituted imidazoline, wherein the N-hydrocarbyl substituted imidazoline is of formula:

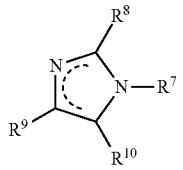

wherein the dashed line indicates resonance, $R^7$ is a hydrocarbyl group containing from 2 to 18 carbon atoms and at least one heteroatom, $R^8$ is hydrogen or a hydrocarbyl group containing from 1 to 40 carbon atoms, and $R^9$ and $R^{10}$ are independently hydrogen or a hydrocarbyl group containing from 1 to 4 carbon atoms wherein the ratio of the at least one salt of a phosphate hydrocarbon ester of 1) to the at least one imidazoline of 2) is from about 1:5 to about 5:1.

2. The lubricating grease of claim 1, wherein the salt of a phosphate hydrocarbon ester is a monoalkyl phosphate, and the monoalkyl group comprises a $C_4$ to $C_{40}$ alkyl group.

3. The lubricating grease of claim 1, wherein the salt of the phosphate hydrocarbon ester is a dialkyl phosphate, and the alkyl groups each comprise, individually, a $C_4$ to C40 alkyl group.

4. The lubricating grease of claim 1, wherein the salt of a phosphate hydrocarbon ester is chosen from an amine salt, an alkali metal salt, an alkaline earth metal salt.

5. The lubricating grease of claim 1, wherein the at least one salt of a phosphate hydrocarbon ester is an amine the salt of a phosphate hydrocarbon ester of formula:

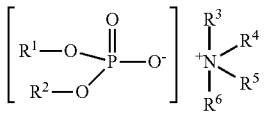

wherein:

$R^1$ and $R^2$ are independently hydrogen or a hydrocarbon containing from 4 to 40 carbon atoms, with the proviso that at least one of $R^1$ or $R^2$ is a hydrocarbon group; and $R^3$, $R^4$, $R^5$ and $R^6$ are independently hydrogen or a hydrocarbyl group containing from 4 to 40 carbon atoms, with the proviso that at least one of $R^3$, $R^4$, $R^5$ and $R^6$ is a hydrocarbyl group.

6. The lubricating grease of claim 1, wherein the $R^7$ N-hydrocarbyl substituent in the at least one N-hydrocarbyl substituted imidazoline comprises a primary, secondary or tertiary alcohol.

7. The lubricating grease of claim 1, wherein the at least one heteroatom of $R^7$ comprises at least one of O, N, S, a halogen, or a combination thereof.

8. The lubricating grease composition of claim 1, further comprising 5) other performance additives.

9. The lubricating grease composition of claim 1, wherein the grease thickener is lithium based.

10. A method of operating a mechanical device comprising A) supplying to the mechanical device a lubricating grease composition comprising 1) a major amount of an oil of lubricating viscosity, 2) about 1.5 to about 10 wt. % of at least one salt of a phosphate hydrocarbon ester, wherein the salt of a phosphate hydrocarbon ester comprises a monoalkyl phosphate, dialkyl phosphate, or mixture thereof, and 3) about 0.5 to about 5 wt % of at least one N-hydrocarbyl substituted imidazoline, and B) operating the mechanical device in the presence of water, wherein the N-hydrocarbyl substituted imidazoline is of formula:

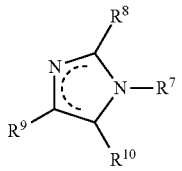

wherein the dashed line indicates resonance, $R^7$ is a hydrocarbyl group containing from 2 to 18 carbon atoms and at least one heteroatom, $R^8$ is hydrogen or a hydrocarbyl group containing from 1 to 40 carbon atoms, and $R^9$ and $R^{10}$ are independently hydrogen or a hydrocarbyl group containing from 1 to 4 carbon atoms wherein the ratio of the at least one salt of a phosphate hydrocarbon ester of 1) to the at least one imidazoline of 2) is from about 1:5 to about 5:1.

* * * * *